US012281425B2

(12) United States Patent
Sans Ravellat et al.

(10) Patent No.: US 12,281,425 B2
(45) Date of Patent: Apr. 22, 2025

(54) TROUSER TREATMENT DEVICE AND CORRESPONDING TROUSER HOLDER

(71) Applicant: JEANOLOGIA, S. L., Valencia (ES)

(72) Inventors: Ramon Sans Ravellat, Sant Quirze del Vallès (ES); Albert Sans Perarnau, Sant Quirze del Vallès (ES)

(73) Assignee: JEANOLOGIA, S. L., Paterna (ES)

( * ) Notice: Subject to any disclaimer, the term of this patent is extended or adjusted under 35 U.S.C. 154(b) by 482 days.

(21) Appl. No.: 17/425,015

(22) PCT Filed: Nov. 18, 2019

(86) PCT No.: PCT/IB2019/059869
§ 371 (c)(1),
(2) Date: Jul. 22, 2021

(87) PCT Pub. No.: WO2020/152519
PCT Pub. Date: Jul. 30, 2020

(65) Prior Publication Data

US 2022/0081818 A1 Mar. 17, 2022

(30) Foreign Application Priority Data

Jan. 23, 2019 (EP) ..... 19382047

(51) Int. Cl.
*D06C 23/02* (2006.01)

(52) U.S. Cl.
CPC ..... *D06C 23/02* (2013.01)

(58) Field of Classification Search
CPC ..... D06C 23/02; D06C 5/005; D06C 5/00; D06B 11/0096; D06B 11/00; D06B 23/04;
(Continued)

(56) References Cited

U.S. PATENT DOCUMENTS 2,582,178 A * 1/1952 Thompson ..... A41H 42/00 211/119.13
2,715,987 A 8/1955 Elrod
(Continued)

FOREIGN PATENT DOCUMENTS

CN 107 723 983 A 2/2018
FR 2 076 274 A5 10/1971
(Continued)

OTHER PUBLICATIONS

English Translation of WO 2017/191347 (Year: 2017).*
International Search Report issued on Mar. 5, 2020 in corresponding application No. PCT/IB2019/059869; 6 pgs.

*Primary Examiner* — Uyen T Nguyen
(74) *Attorney, Agent, or Firm* — Maier & Maier, PLLC

(57) ABSTRACT

A trouser treatment device including a trouser supply module including transport for transporting each of the trousers from an entry to a supply exit, an opening module of the waist of one of the trousers, arranged in the trouser supply module, and a transport module with fastening clamps that hold the trousers with the waist open by the waist and that carries the trousers from the supply exit to a trouser holder of a work station with a processing device and a rotation element able to rotate the trouser holder according to a vertical axis. The trouser holder includes, on each leg, an outer rod and an inner rod, which deploy sideways, and a third rod, arranged between the other two, which is deployed forward or backward.

19 Claims, 13 Drawing Sheets

| Item nº | System | Operation | Duration (s) | Previous item nº | Overlap | Start | End |
|---|---|---|---|---|---|---|---|
| a | Operator | Pick trousers "n" + charge supply module | 6 | | 0 | 0 | 6 |
| b | Transp. Mod. | Transport module picks trousers "n" and places them on trouser holder 1 | 6 | a | 0 | 6 | 12 |
| c | Trouser Holder | Rotation of trouser holder 1 to front marking position | 2 | b | 0 | 12 | 14 |
| d | Operator | Pick trousers "n+1" + charge supply module | 6 | c | 0 | 12 | 18 |
| e | Laser | Front marking of trousers "n" | 20 | c | 0 | 14 | 34 |
| f | Trouser Holder | Rotation of trouser holder 2 to trouser loading/unloading position | 2 | e | 0 | 34 | 36 |
| g | Transp. Mod. | Transp. Mod picks trousers "n-1" from trouser holder 2 and places them on exit station | 4 | f | 0 | 36 | 40 |
| h | Transp. Mod. | Transport module picks trousers "n+1" and places them on trouser holder 2 | 6 | g | 0 | 40 | 46 |
| i | Laser | Back marking of trousers "n-1" | 13 | e | 0 | 34 | 47 |
| k | Trouser Holder | Rotation of trouser holder 2 to front marking position | 2 | h | 0 | 46 | 48 |
| l | Operator | Pick trousers "n-2" + charge supply module | 6 | h | 0 | 46 | 52 |
| m | Laser | Front marking of trousers "n+1" | 20 | i | 0 | 47 | 67 |
| n | Trouser Holder | Rotation of trouser holder 1 to trouser loading/unloading position | 2 | i | 0 | 47 | 49 |
| o | Transp. Mod. | Transp. Mod. picks trousers "n" from trouser holder 1 and places them on exit station | 4 | n | 0 | 49 | 53 |
| p | Transp. Mod. | Transport module picks trousers "n+2" and places them on trouser holder 1 | 6 | o | 0 | 53 | 59 |
| r | Laser | Back marking of trousers "n" | 13 | m | 0 | 67 | 80 |
| s | Trouser Holder | Rotation of trouser holder 1 to front marking position | 2 | p | 0 | 59 | 61 |
| t | Operator | Pick trousers "n+3" + charge supply module | 6 | p | 0 | 59 | 65 |
| u | Laser | Front marking of trousers "n+2" | 20 | r | 0 | 80 | 100 |
| v | Trouser Holder | Rotation of trouser holder 2 to trouser loading/unloading position | 2 | r | 0 | 80 | 82 |
| w | Transp. Mod. | Transp. Mod. picks trousers "n+1" from trouser holder 2 and places them on exit station | 4 | v | 0 | 82 | 86 |
| x | Transp. Mod. | Transport module picks trousers "n-3" and places them on trouser holder 2 | 6 | w | 0 | 86 | 92 |
| z | Laser | Back marking of trousers "n+1" | 13 | u | 0 | 100 | 113 |
| 1 | Trouser Holder | Rotation of trouser holder 2 to front marking position | 2 | x | 0 | 92 | 94 |
| 2 | Operator | Pick trousers "n+4" + charge supply module | 6 | x | 0 | 92 | 98 |

(58) Field of Classification Search
CPC ..... D06B 23/00; A41H 42/00; B65G 17/20; B65G 15/14
See application file for complete search history.

(56) References Cited

U.S. PATENT DOCUMENTS 4,845,790 A * 7/1989 Brasington ..... D06B 11/0096 8/150
4,862,815 A * 9/1989 Thurner ..... D05B 23/007 112/475.12
4,873,878 A * 10/1989 Milton ..... D06H 3/16 356/238.1
5,458,265 A * 10/1995 Hester ..... D06B 11/0096 198/465.1
5,948,120 A * 9/1999 Sights ..... D06M 23/14 8/117
6,648,190 B1 * 11/2003 Manini ..... D06H 3/16 223/76
6,835,258 B2 * 12/2004 Bingham ..... A41H 42/00 156/272.8
2003/0000929 A1 * 1/2003 Bowker ..... B23K 26/0823 219/121.68
2014/0046471 A1 * 2/2014 Bamford ..... G05B 19/048 901/44
2014/0277683 A1 * 9/2014 Gupta ..... G06F 30/00 700/132

FOREIGN PATENT DOCUMENTS

WO 03/029545 A1 4/2003
WO 2014/049567 A1 4/2014
WO 2014/120105 A1 8/2014
WO WO-2017191347 A1 * 11/2017 ..... A41H 5/02
WO WO-2018129217 A1 * 7/2018 ..... D06B 19/00

* cited by examiner

| Item n° | System | Operation | Duration (s) | Previous Item n° | Overlap | Start | End |
|---|---|---|---|---|---|---|---|
| a | Operator | Pick trousers "n" + charge supply module | 6 | | 0 | 0 | 6 |
| b | Transp. Mod. | Transport module picks ousers "n" and places them on trouser holder 1 | 6 | a | 0 | 6 | 12 |
| c | Trouser Holder | Rotation of trouser holder 1 to front marking position | 2 | b | 0 | 12 | 14 |
| d | Operator | Pick trousers "n+1" + charge supply module | 6 | b | 0 | 12 | 18 |
| e | Laser | Front marking of trousers "n" | 20 | c | 0 | 14 | 34 |
| f | Trouser Holder | Rotation of trouser holder 2 to trouser loading/unloading position | 2 | c | 0 | 14 | 16 |
| g | Transp. Mod. | Transp. Mod picks trousers "n-1" fromtrouser holder 2 and places them on exit station | 4 | f | 0 | 16 | 20 |
| h | Transp. Mod. | Transport module picks trousers "n+1" and places them on trouser holder 2 | 6 | g | 0 | 20 | 26 |
| j | Laser | Back marking of trousers "n-1" | 13 | e | 0 | 34 | 47 |
| k | Trouser Holder | Rotation of trouser holder 2 to front marking position | 2 | h | 0 | 26 | 28 |
| l | Operator | Pick trousers "n+2" + charge supply module | 6 | h | 0 | 26 | 32 |
| m | Laser | Front marking of trousers "n+1" | 20 | j | 0 | 47 | 67 |
| n | Trouser Holder | Rotation of trouser holder 1 to trouser loading/unloading position | 2 | j | 0 | 47 | 49 |
| o | Transp. Mod. | Transp. Mod. Picks trousers "n" from trouser holder 1 and places them on exit station | 4 | n | 0 | 49 | 53 |
| p | Transp. Mod. | Transport module picks trousers "n+2" and places them on trouser holder 1 | 6 | o | 0 | 53 | 59 |
| r | Laser | Back marking of trousers "n" | 13 | m | 0 | 67 | 80 |
| s | Trouser Holder | Rotation of trouser holder 1 to front marking position | 2 | p | 0 | 59 | 61 |
| t | Operator | Pick trousers "n+3" + charge supply module | 6 | p | 0 | 59 | 65 |
| u | Laser | Front marking of trousers "n+2" | 20 | r | 0 | 80 | 100 |
| v | Trouser Holder | Rotation of trouser holder 2 to trouser loading/unloading position | 2 | r | 0 | 80 | 82 |
| w | Transp. Mod. | Transp. Mod. picks trousers "n +1" from trouser holder 2 and places them on exit station | 4 | v | 0 | 82 | 86 |
| x | Transp. Mod. | Transport module picks trousers "n+3" and places them on trouser holder 2 | 6 | w | 0 | 86 | 92 |
| z | Laser | Back marking of trousers "n+1" | 13 | u | 0 | 100 | 113 |
| 1 | Trouser Holder | Rotation of trouser holder 2 to front marking position | 2 | x | 0 | 92 | 94 |
| 2 | Operator | Pick trousers "n+4" + charge supply module | 6 | x | 0 | 92 | 96 |

FIG. 1

TROUSER TREATMENT DEVICE AND CORRESPONDING TROUSER HOLDER

FIELD

The invention relates to a trouser treatment device and a trouser holder for the treatment of jeans. Preferably the trousers are denim type jeans.

BACKGROUND

There are several technologies of treating trousers, in particular denim type jean trousers, that are well known. These treatments include a plurality of alternatives, such as laser treatment, chemical treatment, mechanical abrasion treatments, etc. Usually the trousers to be treated are positioned in a trouser holder that keeps the trousers stretched during the treatment process.

This positioning is done manually. However, the operation of positioning the trousers in the trouser holder is a step that requires a considerable amount of time and that, in addition, is a delicate operation since improper positioning will cause the subsequent treatment to render inadequate results. For this reason, it is necessary to have more than one operator for each trouser holder, so that they can rotate and thus have rest periods. Since it is usual for treatment facilities to be in continuous operation (24 hours a day, that is, three work shifts), labor costs have a significant impact on the total cost of the treatment.

US 2003/000929 A1 describes an apparatus and method for forming simulated wear patterns and designs in denim pants using laser rays. The apparatus includes an indexable carousel having a plurality of circumferentially spaced pant-supporting mandrels that are sequentially indexable to a plurality of stations located about the carousel, including a loading station, a laser station, and an unloading station. The mandrels each comprise articulated linkage that is selectively actuatable between a retractable condition that permits positioning of a pair of pants onto the mandrel at the loading station and an expanded condition that tautly supports the pants in predetermined position at the laser station such that a laser generated pattern can be formed at predetermined locations on the pants.

WO 03/029545 A1 discloses a method for the tracing of marks on the surface of a garment with a laser beam wherein the tracing is carried out by arranging the garment in the position it takes on when it is worn. The apparatus which executes the method comprises a generator of a laser beam connected to a scanner that paints the laser beam against the garment and a supporting casing of the garments. Inside the casing one or more tailor's dummies are found, each one of them comprises a frame which bears grip means and adjustment means in order to arrange the garment in the position that it takes on when it is worn.

WO 2017/191347 A1 relates to a mannequin for the surface treatment of trousers, which comprises an upper support structure from which two legs extend, each leg having an inflatable balloon disposed on the rear part thereof. The outer lateral section of each balloon is folded at least once around a folding line that extends from the upper edge to the lower edge of the balloon. The upper edge is secured to the upper end on the rear of the leg and the lower edge is secured at an intermediate point on the rear of the leg, such that the parts of the edges corresponding to the outer lateral section are also secured to the leg of the mannequin.

WO 2014/120105 A1 describes a mannequin cabinet system for laser marking process. It has a rotating door, is compact in size and protects the operator against laser beam. It is modularly designed so that up to 4 mannequin cabinet systems can be used together for laser marking in one machine.

SUMMARY

The object of the invention is to overcome these drawbacks. This purpose is achieved by means of a trouser treatment device characterized in that it comprises:

[a] a trouser supply module, where each of the trousers is manually inserted by an operator and is retained by the waist and hangs vertically,

[b] a work station with a trouser holder and a processing device, where the trouser holder has two legs able to lodge inside the legs of the trousers, where each leg defines a longitudinal axis, where the trouser holder has a front part, corresponding to the front part of the trousers, and a back part, where each one of the legs has an inner edge, proximate to the other leg, and an outer edge, opposite the inner edge, and

[c] a transport module with fastening clamps able to hold by the waist the trousers, the transport module being able to transport the trousers from the supply module to the trouser holder.

It has to be understood that, when the transport module transports the trousers form the supply module to the trouser holder it also puts the trousers over the trouser holder so that each leg of the trouser holder is in the corresponding leg of the trousers, i.e., the transport not only includes a mere translation from one place to another but also the positioning of the trousers over the trouser holder so that each leg of the trouser holder is in the corresponding leg of the trousers. The device according to the invention allows positioning of the trousers for their subsequent processing (for example, laser marking), with minimum operator intervention, meaning a reduction of trouser supply times. Additionally, it enables the supply of several devices with a minimum number of operators. The transport module moves the trousers to a trouser holder and places them on the trouser holder in a precise and repetitive manner, unloading the operator of this function, which was one of the functions that involved more time and stress for the operator.

The trouser supply module supplies the trousers vertically, allowing the operator to work in a standing position.

Preferably the work station has two trouser holders and the transport module is able to transport the pair of trousers from the supply module to any of the trouser holders. As with the new device the time that the operator needs to put the trousers into the trouser supply module is greatly reduced, it is possible to feed two trouser holders, increasing the productivity.

Preferably the supply module comprises transport means for transporting each of the trousers from a supply entry to a supply exit and the transport module (5) is able to transport the pair of trousers from the supply exit to the transport holder or, if the work station has two trouser holders, to any of the trouser holders. The transport means allow the creation of a trouser reservoir, which facilitates both the supply of the device and the relaxation of the operator. This also means that the operator is not the limiting element on the total amount of trousers processed per hour. The operator inserts the trousers through the supply entry one after the other, and the reservoir is generated in the transport means. The trousers are transported sequentially to the supply exit.

Preferably the device according to the invention comprises an opening module of the waist of one of the trousers, arranged at the trouser supply module, and the transport module with fastening clamps is able to hold by the waist the pair of trousers with an open waist. The opening module of the waist of each of the trousers facilitates the subsequent gripping of the same by the transport module fastening clamps. Subsequently, as said before, the transport module moves the trousers to a trouser holder and places them on the trouser holder in a precise and repetitive manner, unloading the operator of this function, which was one of the functions that involved more time and stress for the operator.

The processing device performs the corresponding operation on the trousers (for example, the laser marking) and, once completed, the trousers are removed from the trouser holder and taken to an exit station. This can be done, for example (and preferably), simply using the gravity force, so that the trousers fall to a conveyor belt below the trouser holder that takes them to an exit station, although other ways of removing the trousers can be used, for example, the transport module, in particular if it comprises a robotic arm (see below) can remove the trousers from the trouser holder and take them to an exit station.

Preferably the work station comprises rotation means able to rotate the trouser holder according to a vertical axis or, if the work station has two trouser holders, the work station comprises rotation means able to rotate said trouser holders according to a vertical axis. So, to accomplish the processing at the front and at the back of the trousers, the trouser holders rotate 180° on themselves, according to a vertical axis. Preferably the device according to the invention comprises rotation means in the work station forming part of the own trouser holder that allow this rotation. Preferably the rotation means allow the trouser holders to rotate other angles (such as 90°), which may allow the seam areas to be also treated. For this purpose, the rotation means advantageously have a controlled rotation motor, which allows the trousers to be oriented with respect to the processing device at any angle, thus allowing, to perfectly process the lateral parts of trousers. Currently, the known positioning methods do not allow this possibility.

With the device according to the invention, the operator practically has no interaction with the device, only participates in the trouser supply into the supply module. This operation is very fast, comfortable, and does not require positioning the trousers with excessive precision.

In FIG. 1, a cyclogram of process times in the case of laser marking is shown. The operation to be performed by the operator is particularly fast and has a high amount of downtime. From the cyclogram of process times it can be observed that, by maintaining the front marking cycle times of 20 seconds, the back marking of 13 seconds, the loading (6 seconds) and unloading (4 seconds) operations of the transport module and the trouser rotation times (from the loading/unloading position of the trousers to the marking position (2 seconds) and from the marking position to the loading/unloading position (2 seconds)):

- the front marking cycle time can be reduced up to 6 seconds
- the back marking cycle time can be reduced as much as possible without any restriction.

This increase in production is given by the improvements provided by the device according to the invention:

- elimination of the operators accumulated fatigue during the shift caused by the operation of loading the trousers in a trouser holder and collecting the trousers after their processing (for example marking), in the conventional procedure. This procedure, as indicated above, generated an increase in time for this operation.
- the device according to the invention has a fast trouser loading system, which is easy for the operator. Indeed, the supply of a trouser supply module, where each of the trousers is retained by the waist and hangs vertically, is much faster, easier and rested for the operator than direct loading of the trousers.
- the presence of transport means in the supply module allows the formation of a small trouser reservoir, which ensures continuity in the supply of trousers "downstream".
- with the device according to the invention all operations can be carried out in parallel, with the exception of front and back processings, which are still the minimum necessary to have processed trousers. This renders the trouser processing production only dependent on processing times, leaving open the possibility of acting upon them to improve even more the increase in production.

This unloading of the operators work allows to consider alternatives in which the same operator supplies more than one work station:

1—in a preferred solution, the device according to the invention additionally comprises a second work station with a trouser holder (or, preferably, with two trouser holders) and a processing device, the second work station preferably also comprising rotation means able to rotate the trouser holders according to a vertical axis, where the transport module is able to transport the trousers from the supply module (preferably from the supply exit) to the trouser holder (or, preferably, to any of the trouser holders if there are two of them) of the second work station. In this way, the device has a single trouser supply module, fed by an operator, and a single transport module the fastening clamps of which hold the trousers that will be later placed on the trouser holders of any of the two work stations, and two work stations, with the consequent increase in productivity. The other preferred alternatives described in respect of the device with only one work station are also preferred alternatives for this two work stations alternative.

2—in another preferred solution, the device according to the invention comprises [i] a trouser supply module, where each of the trousers is retained by the waist and hangs vertically, the supply module comprising transport means for transporting each of the trousers from one supply entry to three supply exits, so that each of the trousers is carried from the supply entry to one of the supply exits and [ii] three blocks, each one related to a supply exit and each of them comprising: [ii.a] two work stations (each with a trouser holder (or preferably two of them), a processing device and, preferably, rotation means able to rotate the trouser holders according to a vertical axis), and [ii.b] a transport module. Each transport module has fastening clamps able to hold by the waist the trousers (preferably with an open waist). Additionally, each transport module is able to transport the trousers from the supply exit (the one that is related to the block to which it belongs) to any of the trouser holders (of the two stations related to the block to which it belongs).

The opening module can be of various ways. Thus, a preferred solution is that the opening module is arranged at the supply exit. In this case, it preferably comprises needles for opening said waist. In another preferred solution, the opening module comprises pneumatic means suitable for opening the waist by suction, by means of an air clamp system. In general, any method that allows the opening of the waist can be adequate, appropriately fixing the fabric that conforms the waist. In an alternative preferred solution, the transport means comprise a closed loop circuit and a plurality of transporting units, where each of the transporting units comprises an opening module that includes two fingers able to be positioned inside the waist of the trousers, and where the distance between both fingers is adjustable.

Preferably, the trouser holder (or each of the trouser holders, if there are two of them) comprises a top support structure, with a fixing area of the upper part of trousers, and from which extend the two legs. Each leg comprises a front face (preferably flat) and a back face and a hollow space therebetween where an outer rod and an inner rod (also called sabers) are lodged. The lower ends of the outer and inner rods are attached to a rod deploying mechanism able to deploy them towards the outside and towards the inside, respectively, so that the outer and inner seams of the trousers are placed on each of the rods.

The back face of each leg may be flat, but preferably includes a system of inflatable balloons in order to reproduce the human body more realistically. Thus, the processing (for example, the laser marking) can be done in a more realistic way.

Advantageously, the trouser holder (or any of the trouser holders, if there are two of them) comprises a third rod arranged between both rods and a deployment mechanism of the third rod able to deploy said third rod towards the front or towards the back, that is to say, perpendicular to the plane defined by the other two rods. Once the transport module has positioned the trousers on the trouser holder, first, the third rod is deployed and then the outer rod and the inner rod are deployed (these two are deployed simultaneously). Once the outer rod and the inner rod are deployed, the third rod is retracted, i.e., the deployment mechanism is able to have the third rod in a retracted position when the outer rod and the inner rod are in a deployed position. The use of the third rod improves the correct positioning of the trousers in the trouser holder, in particular the positioning of the outer rod and the inner rod in the side seams of the trousers. This precise positioning allows improvement of the processing quality, which is predetermined assuming the trousers are in the correct position.

Preferably, the trouser holder (or any of the trouser holders, if there are two of them) comprises adjustment means able to adjust the fixing area of the upper part of trousers, comprising a servomechanism. Indeed, it is convenient that the trouser holders are able to adjust to different sizes, but without deforming the waist area of the trousers. The servomechanism is able to adjust the fixing area to the sizes of all trousers without creating excessive tensions, as is usually the case with pneumatic devices. For its part, the fastening clamps also mean an improvement over the positioning performed by a person, since the clamps exert pressure on the entire waist of the trousers, while the operator can only hold the trousers by the ends of the waist, with which the stretching effect is lower at the central part. Thus, with the device according to the invention, the positioning of each pair of trousers is in the same position, but the opening will depend on the size, which is performed in a servo-controlled manner.

Preferably the transport module comprises a robotic arm having the fastening clamps, the robotic arm being able to transport the pair of trousers from the supply module to the trouser holder or, if the work station has two trouser holders, the robotic arm being able to transport the pair of trousers from the supply module to any of the trouser holders.

Preferably the processing device is a laser device, a chemical treatment device or a mechanical abrasion device, and more preferably it is a laser device.

The invention also relates to a trouser holder for the trouser treatment comprising a top support structure, rotation means able to rotate the trouser holder according to a vertical axis, and a fixing area of the upper part of trousers, and from which two legs able to lodge inside the trouser legs extend, where each leg defines a longitudinal axis, where the trouser holder has a front part, corresponding to the front of the trousers, and a back part, where each of the legs has an inner edge, close to the other leg, and an outer edge, opposite the inner edge, and where each leg comprises a front and a back face and a hollow space therebetween where an outer rod and an inner rod are lodged, where the lower ends of the outer and inner rods are attached to a rod deployment mechanism able to deploy them towards the outside and towards the inside, respectively, where the trouser holder comprises a third rod arranged between both rods and a third rod deployment mechanism able to deploy the third rod towards the front or towards the back.

The trouser holder defines a central axis, extending in the longitudinal direction of the trousers when mounted on the trouser holder. Although the trouser holder could theoretically be installed in any direction in space (e.g., horizontally or inclined to the direction of gravity), the real case is that the trouser holder according to the invention will be placed always in such a way that his central axis is vertical. Therefore, in the present description and claims the central axis of the trouser holder has been directly named as "the vertical axis".

Advantageously, the trouser holder comprises adjustment means, able to adjust the fixing area of the upper part of trousers, comprising a servomechanism.

BRIEF DESCRIPTION OF THE DRAWINGS

Other advantages and characteristics of the invention can be seen from the following description, in which, without any limiting character, some preferred embodiments of the invention are described, with reference to the accompanying drawings. The figures show:

FIG. 1, a table with a timeline of process times.

DETAILED DESCRIPTION OF EMBODIMENTS

The following embodiments have been based on a particular case where the processing device is a laser device. While being a preferred option, it has to be understood that the invention is not limited to the particular case where the processing device is a laser device. As has been stated before, the invention also covers cases in which the processing device is performing any other processing to the trousers as, for example, chemical processing or mechanical abrasion processing.

FIG. 1 shows a table with a timeline of process times. For each step (item no.) it is specified which element within the system performs the step (operator, transport module, trouser holder, laser device), a brief description of the operation, its duration (in seconds), which is the previous step that must be carried out, the possible overlap, the step starting time and the step ending time.

Figure 2:
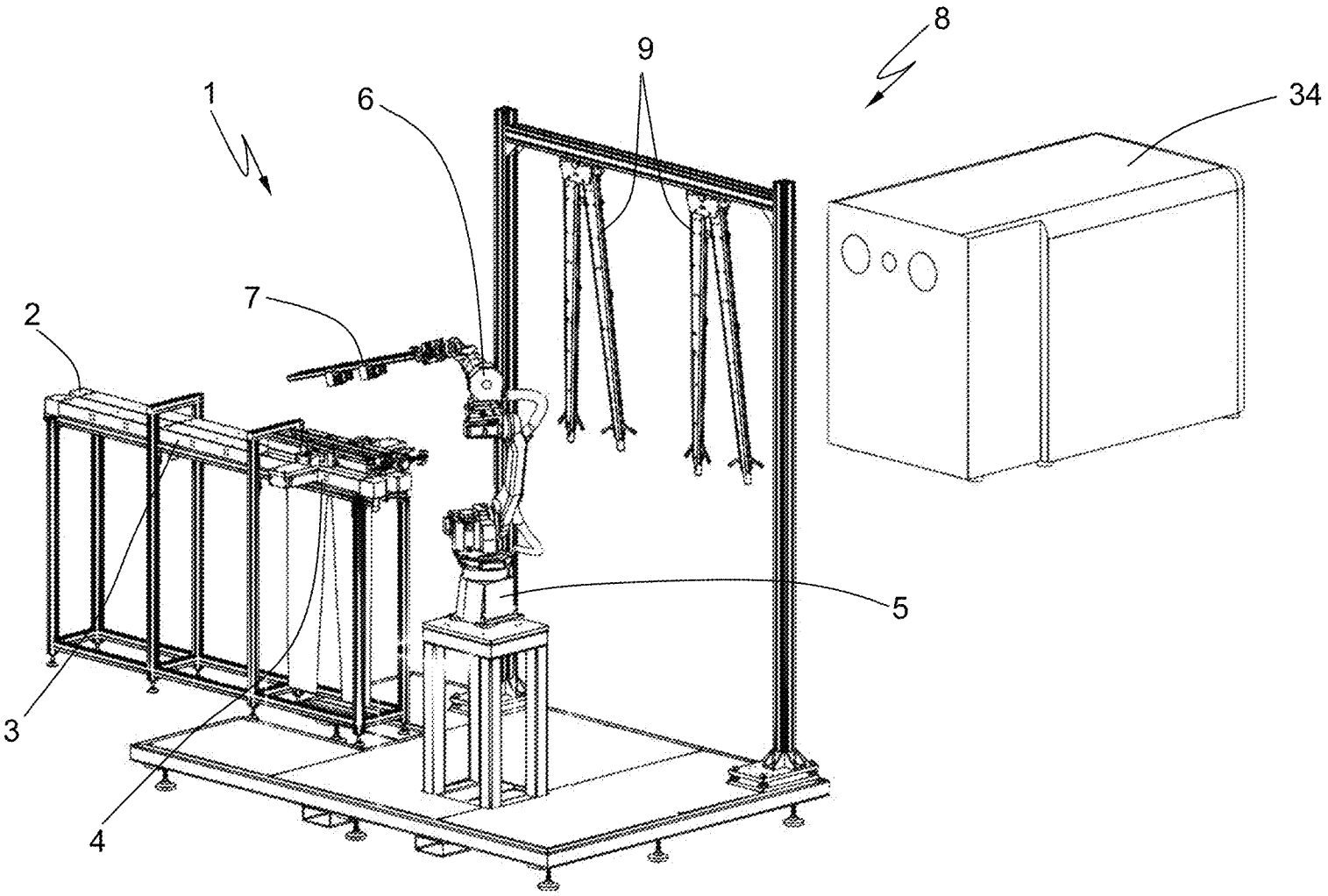
FIG. 2, a perspective, schematic view of a first device according to the invention.

FIG. 2 shows a schematic perspective view of a first trouser laser treatment device according to the invention. The device comprises a trouser supply module 1, which is fed with trousers by an operator (not shown in the Fig.) through a supply entry 2. The trousers are transported by transport means 3 to a supply exit 4. In the transport means 3 a plurality of trousers can be accumulated, allowing for the creation of a reservoir that guarantees the regular arrival of trousers to the supply exit 4. A transport module 5, composed of a robotic arm 6 having fastening clamps 7 at its end, can pick trousers from the supply exit 4 and take them to a work station 8 in which there are two trouser holders 9. The work station 8 also has a laser device 34 that will treat the trousers arranged at the trouser holders 9. Once a pair of trousers has been treated, the treated trousers are taken to an exit station. This can be done by the transport module 5 or simply through a conveyor belt (or similar device) put below the trouser holder and allowing that the treated trousers fall to the conveyor belt thanks to the gravity force (or any other pushing or pulling device).

Figure 3:
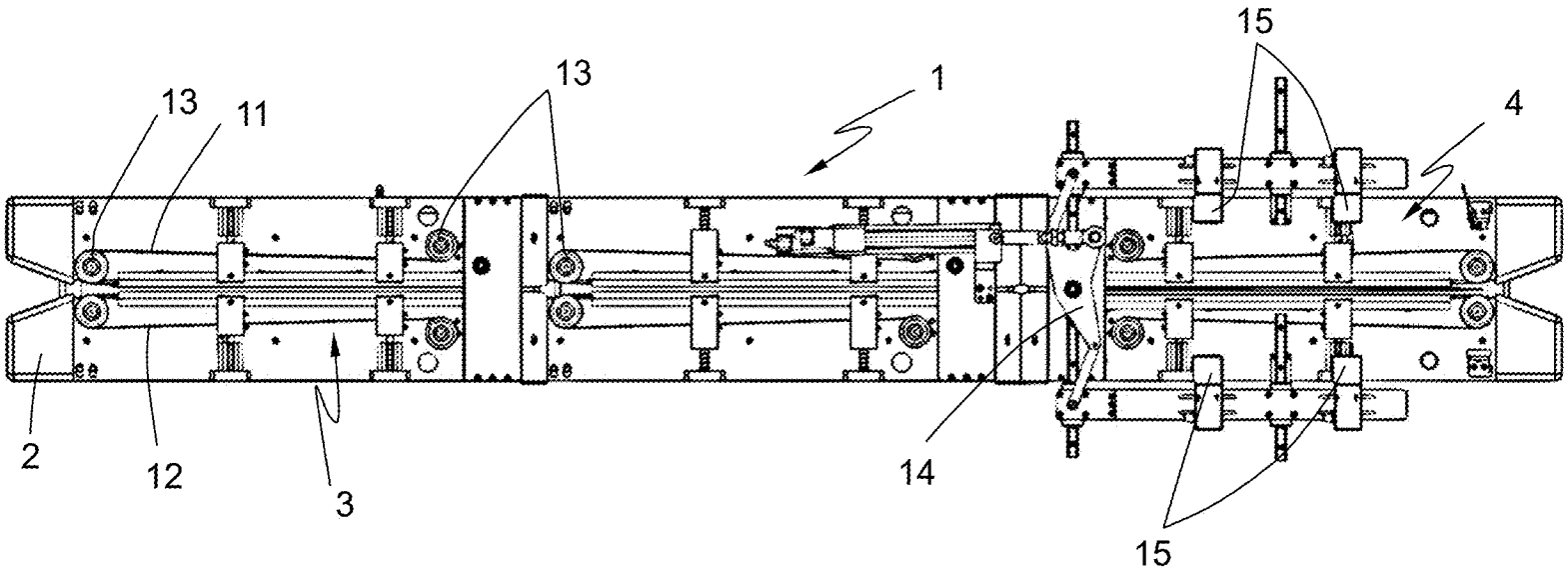
FIG. 3, a top plan view of a first alternative of supply module.
Figure 4A:
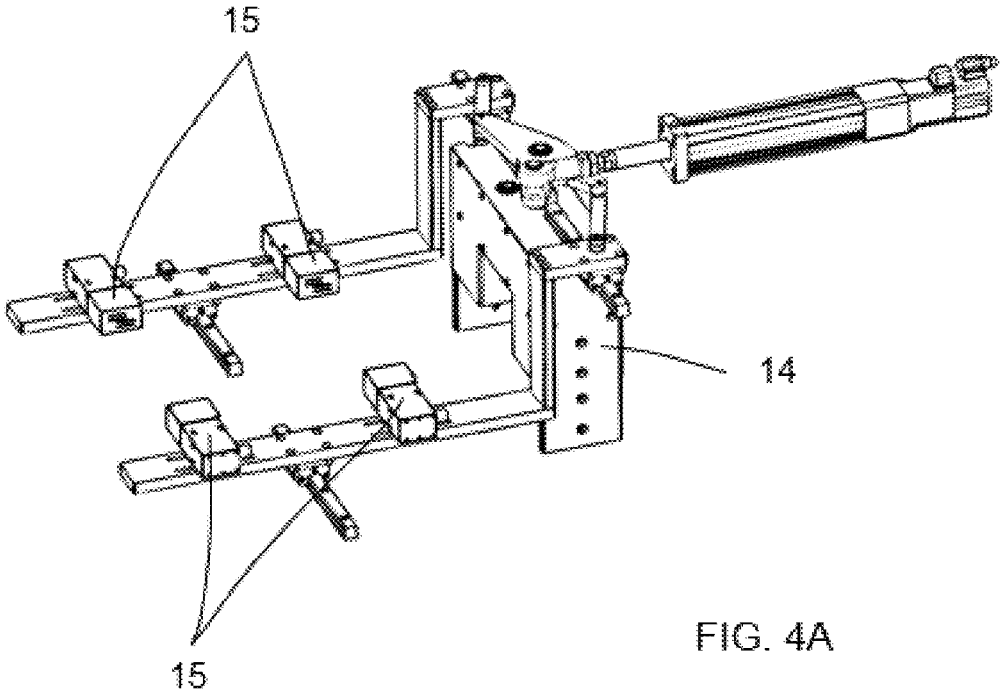
FIG. 4, a perspective view of a head of an opening module.
Figure 4B:
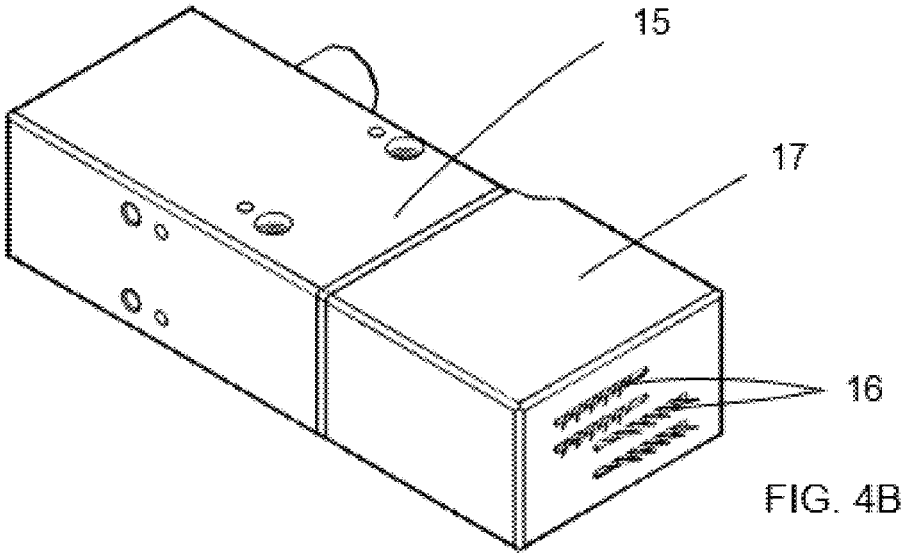

The supply module 1 (see also FIGS. 3 and 4) has a supply entry 2 wherein the operator can introduce the waist of the trousers between two conveyor belts 11 and 12. Rollers 13 drag and guide the two conveyor belts 11 and 12, each of which rests on one side of the waist of the trousers, dragging it along with it, and transporting it from the supply entry 2 to the supply exit 4.

The opening module 14 of the waist of the trousers is located at the supply exit 4. It comprises two needle units 15, each positioned at one side of the waist of the trousers arranged at the supply exit 4. Each of the needle units has a head 17 that can be moved between a contact position, wherein the head 17 is in contact with the waist of the trousers, and an opening position. When a pair of trousers, arranged at the supply exit 4, has to be opened by the waist (i.e., before the fastening clamps 7 hold the trousers, and precisely to facilitate that the fastening clamps 7 can hold better the trousers by the waist) the heads 17 approach towards the trousers, each on one side of the trousers, until reaching the respective contact positions. Next, needles 16 extend, arranged on the face of the head 17 in contact with the trousers. The needles 16 extend at a non-zero angle with respect to the movement direction of the head 17 and are driven into the waist. Then the heads 17 are each removed to their open position and, thanks to the needles driven into the fabric, each head 17 carries with it the part of the waist with which it is in contact. In this way, the perimeter of the waist of the trousers is open and easily accessible for the fastening clamps 7. While in the embodiment shown in FIG. 3 the opening module 14 has two needle units 15 (one at each side of the trousers), other preferred solutions are possible, as for example with two needle units 15 at each side of the trousers.

Figure 5:
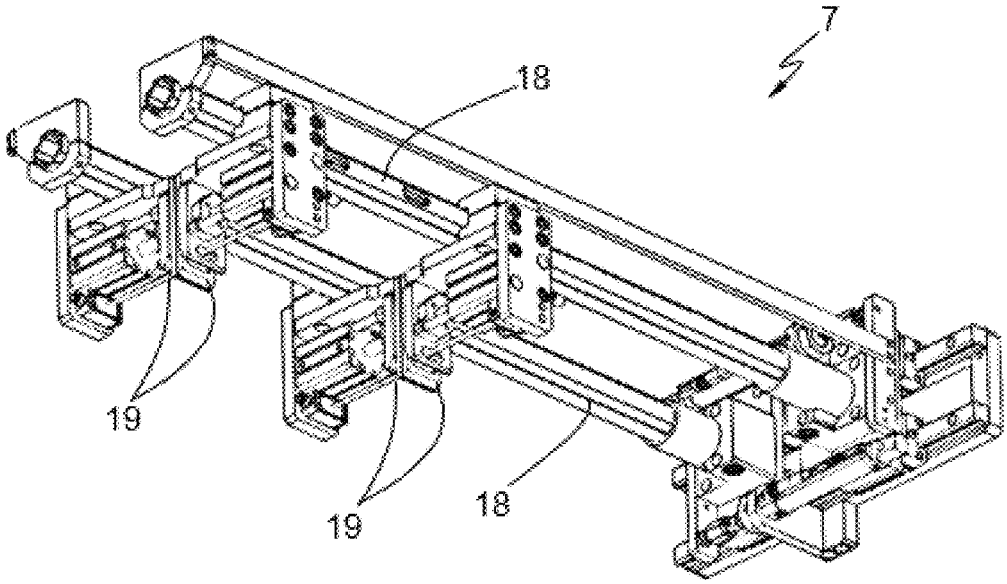
FIG. 5, a bottom perspective view of fastening clamps of a transport module.
Figure 6:
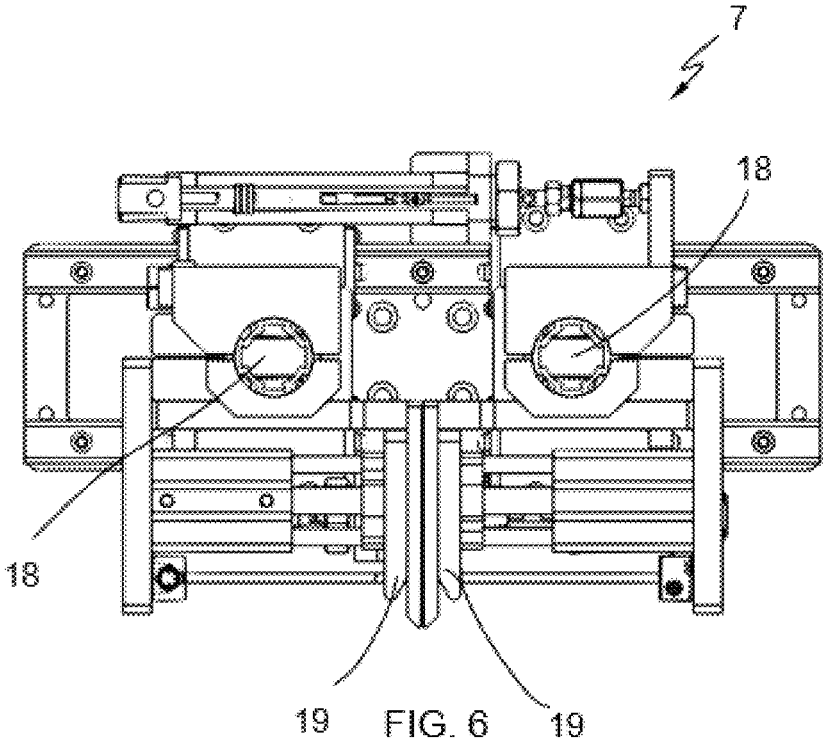
FIG. 6, a front elevation view of the fastening clamps of FIG. 5.
Figure 7:
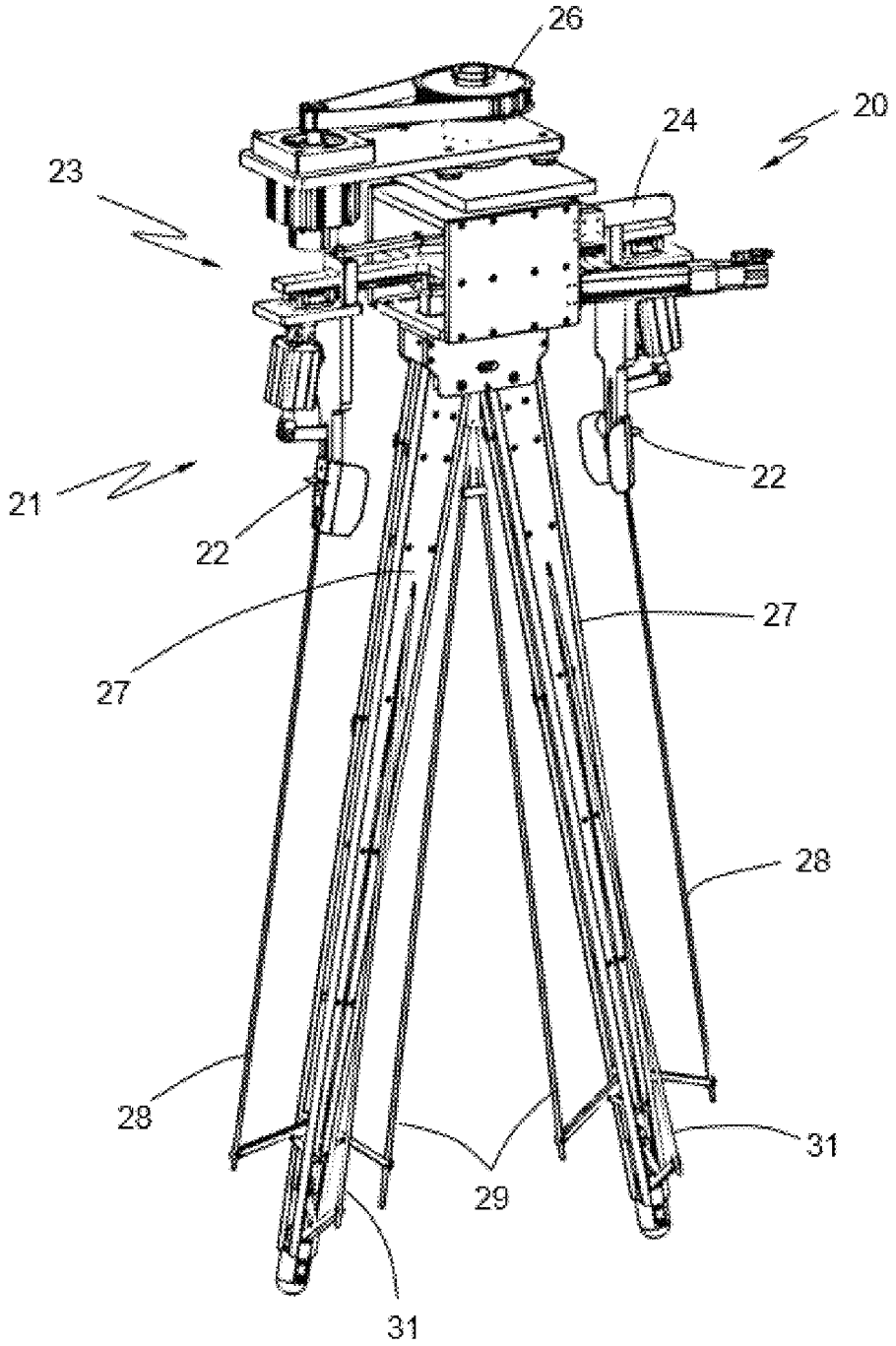
FIG. 7, a perspective view of a trouser holder.
Figure 8:
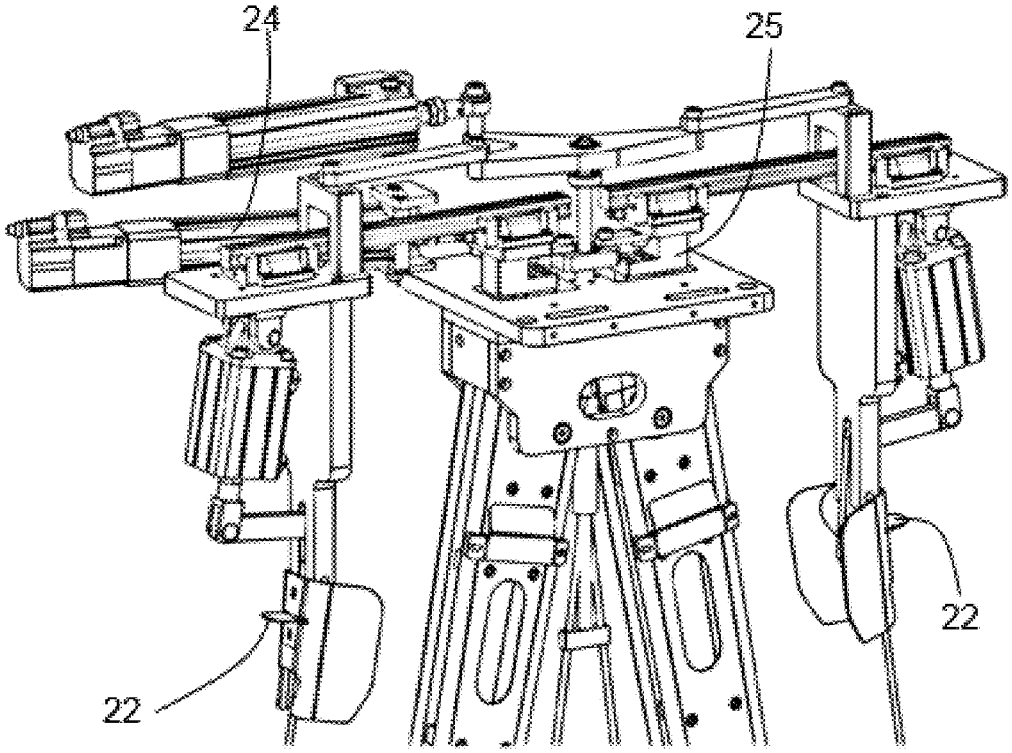
FIG. 8, an enlarged, partial view of the top part of the trouser holder of FIG. 7.
Figure 9:
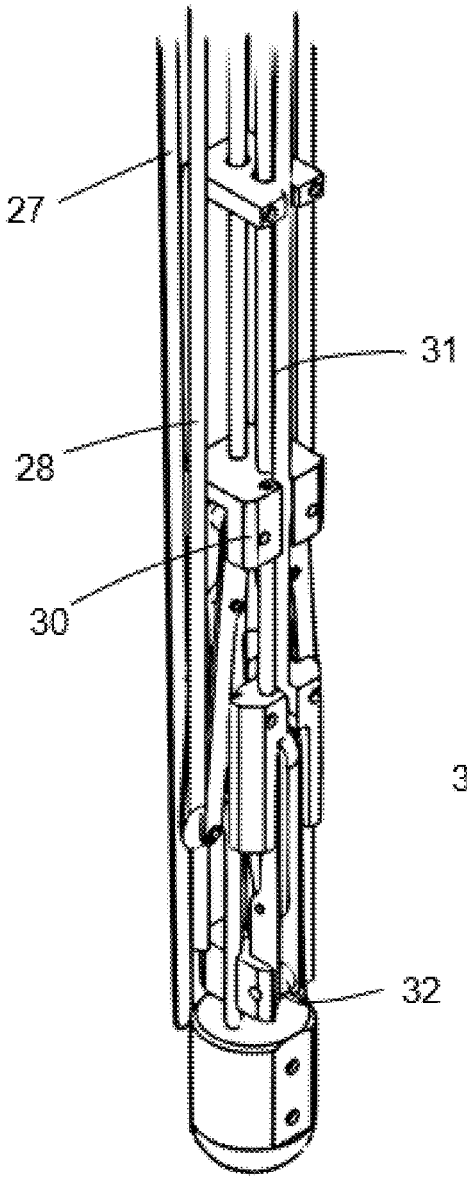
FIG. 9, a perspective view of the lower part of a leg of a trouser holder, with the three rods (outer rod, inner rod and third rod) folded.
Figure 10:
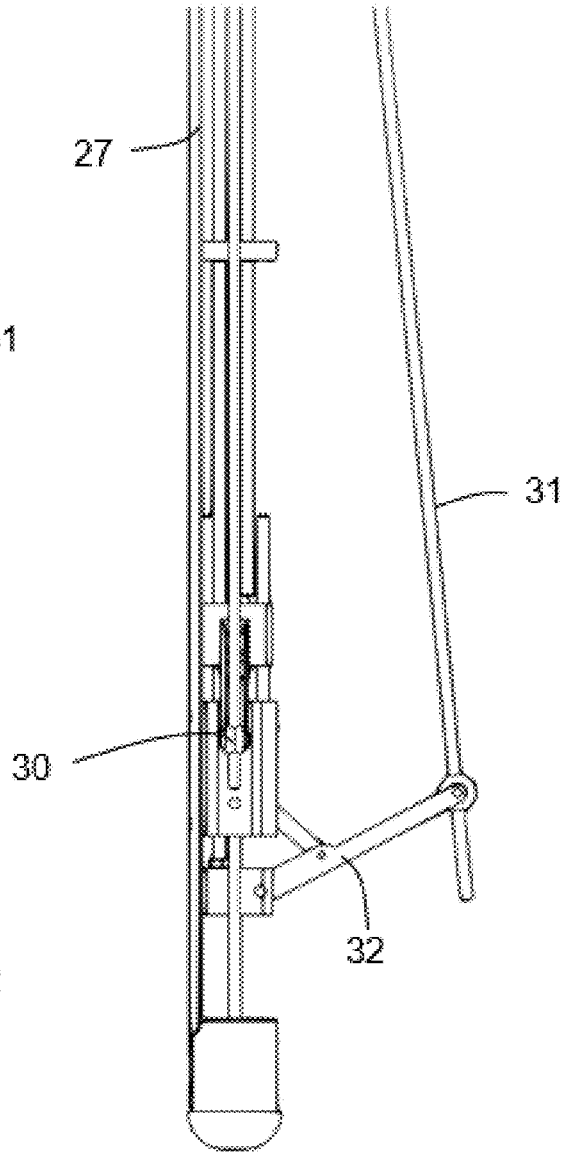
FIG. 10, a side elevational view of the leg of FIG. 9 with the third rod unfolded.
Figure 11:
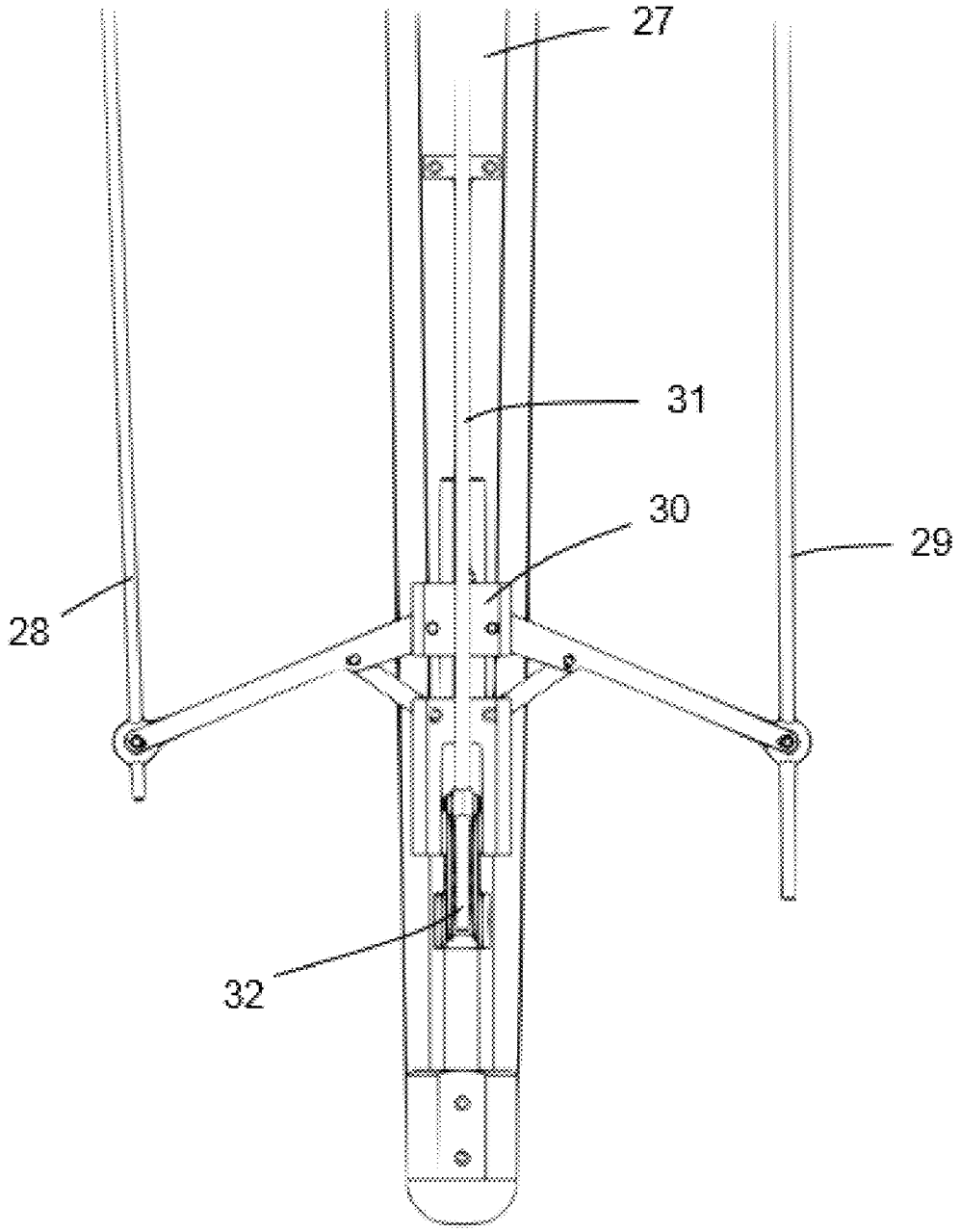
FIG. 11, a front elevation view of the leg of FIG. 9 with the outer rod and the inner rod unfolded.

The transport module 5 comprises a robotic arm 6 having fastening clamps 7 (see FIGS. 5 and 6) at its end. The fastening clamps 7 comprise two arms 18 with two clamps 19 in each of them.

Each of the trouser holders 9 (see FIGS. 7-11) comprises a top support structure 20, with a fixing area 21 of the upper part of trousers. In the fixing area 21 there are stops 22 for correctly positioning the waist of the trousers. The support structure 20 also has adjustment means 23 that allow adjusting the width of the fixing area 21, so that it can adapt to different sizes of the trousers to be treated. To this end, a servomotor 24 acts on a mechanism 25 that allows to adjust the distance between the stops 22 to the different sizes of the trousers. The support structure 20 also has rotation means 26 able to rotate the trouser holder 9 according to a vertical axis.

Each trouser holder 9 has two legs 27, for each of the trouser legs. The trouser holder 9 has a front part, corresponding to the front of the trousers, and a back part, and each of the legs 27 has an inner edge, next to the other leg 27, and an outer edge, opposite the inner edge. Each leg 27 comprises a flat front face and a flat back face and a hollow space therebetween where an outer rod 28 and an inner rod 29 are lodged, where the lower ends of the outer 28 and inner 29 rods are attached to a deployment mechanism 30 which deploys them towards the outside and towards the inside, respectively.

The trouser holder 9 additionally comprises a third rod 31 arranged between both rods 28 and 29 and a deployment mechanism 32 of said third rod 31 that deploys it toward the front of the trouser holder 9.

The three rods 28, 29 and 31 (also known as sabers) are made of very flexible material that allows the stretching of the trousers on the outside and inside by means of an automatic process. So that the trousers can be placed in the trouser holder 9, it is necessary that the rods 28, 29 and 31 are "folded", that is, they are located on both sides of the two flat faces. When the pair of trousers is located inside the trouser holder 9, first, the third rod 31 is deployed and then the outer rod 28 and the inner rod 29 are deployed and the third rod 31 is retracted. As the rods are of a flexible material but at the same time with a specific hardness it is possible for the rods to open the trousers but to adapt to their shape and size in such a way that they open the trousers correctly and do not deform their clothing.

Figure 12:
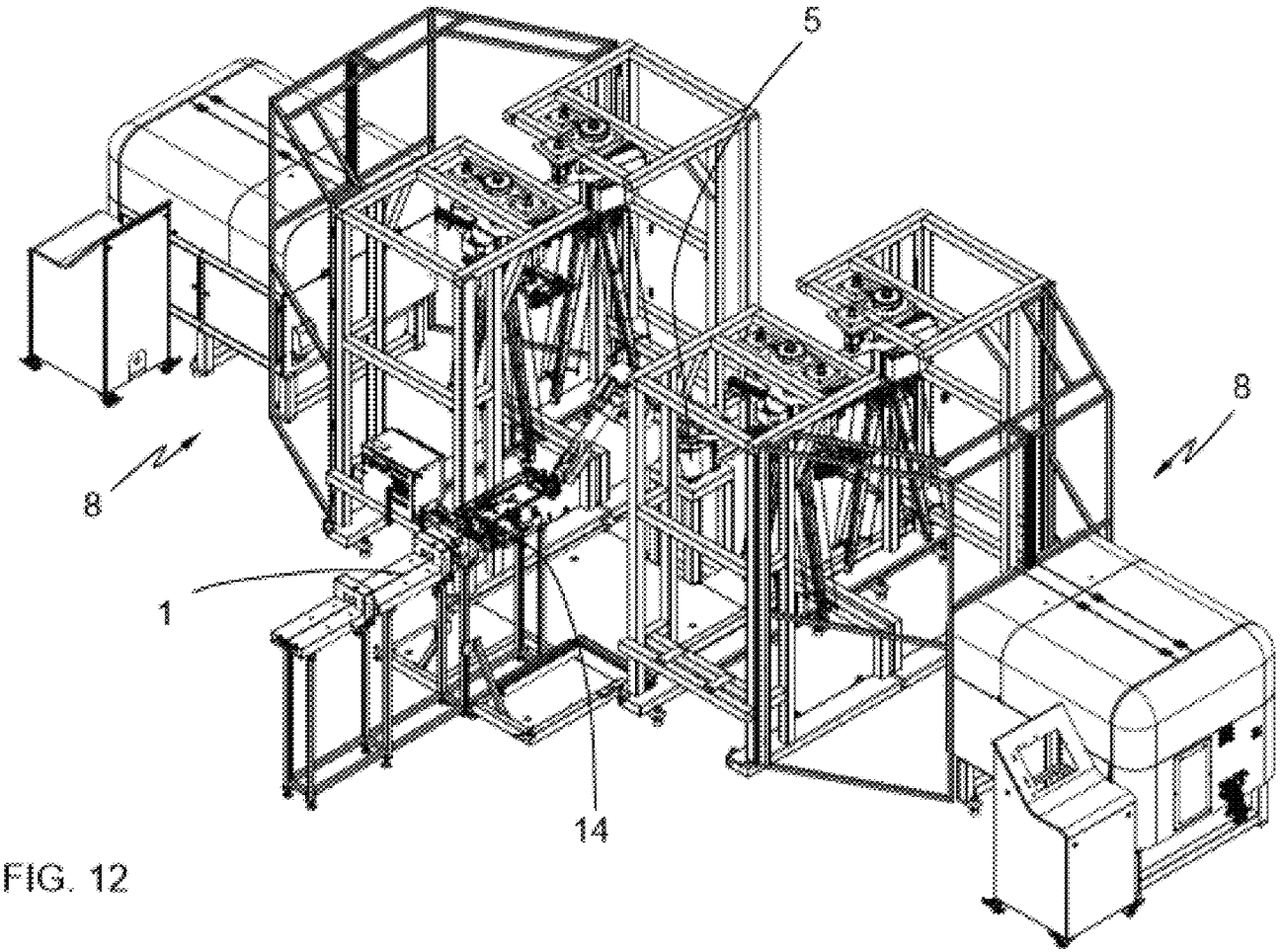
FIG. 12, a perspective view of a second device according to the invention.

In FIG. 12 a preferred embodiment of a device according to the invention is shown. The device comprises a trouser supply module 1 and an opening module 14 of the waist of one of the trousers, as described above. Next to the supply exit 4 there is a transport module 5, as described above, and two work stations 8, each of them as described above. That is, the trouser supply module 1 and the opening module 14 serve to supply trousers to two work stations 8. In this way a single device, fed by a single operator, can double the production capacity of treated trousers.

Figure 13:
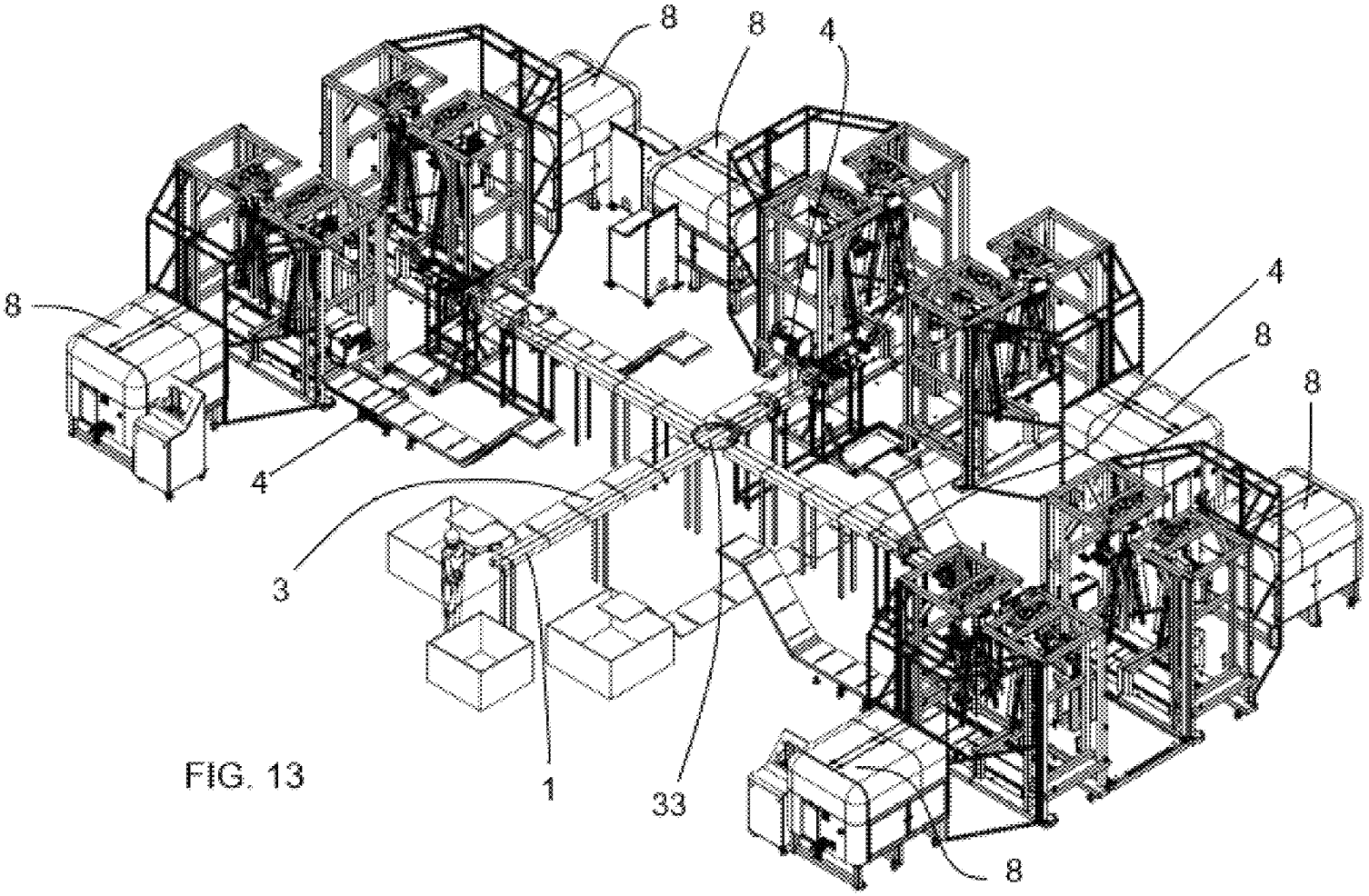
FIG. 13, a perspective view of a third device according to the invention.
Figure 14:
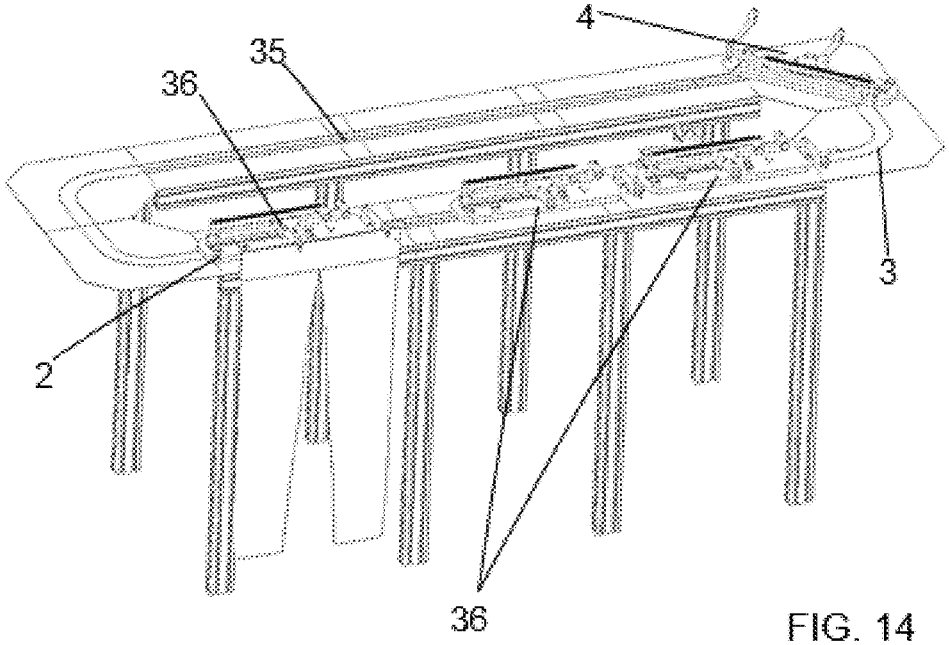
FIG. 14, a perspective view of a second alternative of a supply module.
Figure 15:
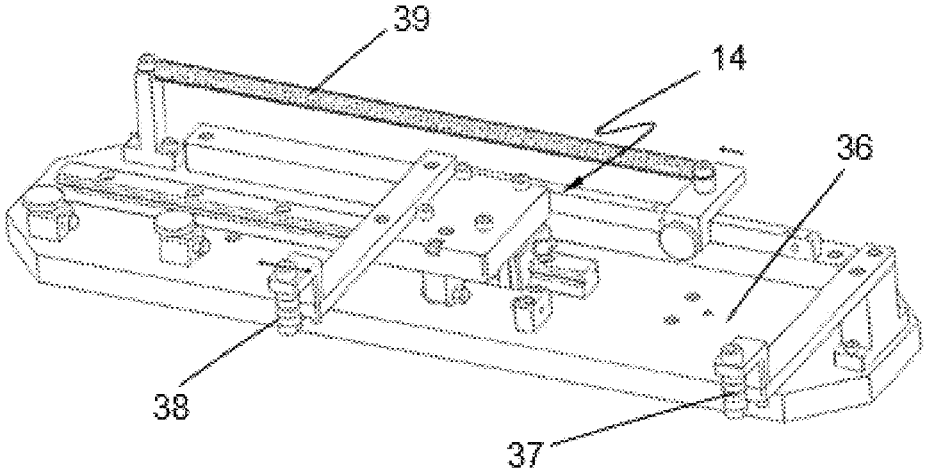
FIG. 15, a perspective view of a transporting unit of the supply module of FIG. 14.
Figure 16:
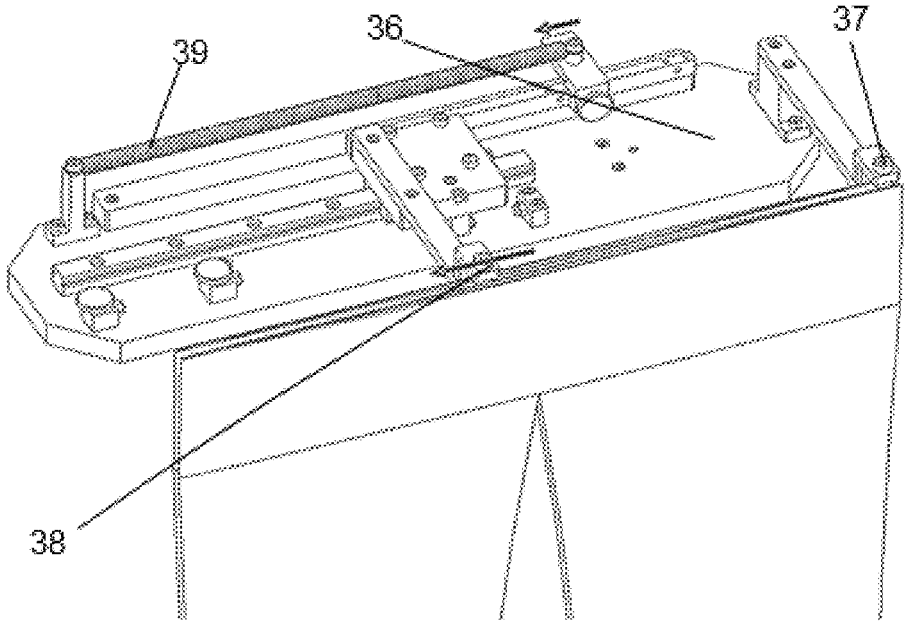
FIG. 16, a perspective view of the transporting unit of FIG. 15, with both fingers in the waist of a pair of trousers, where the moving finger is in a retracted position.
Figure 17:
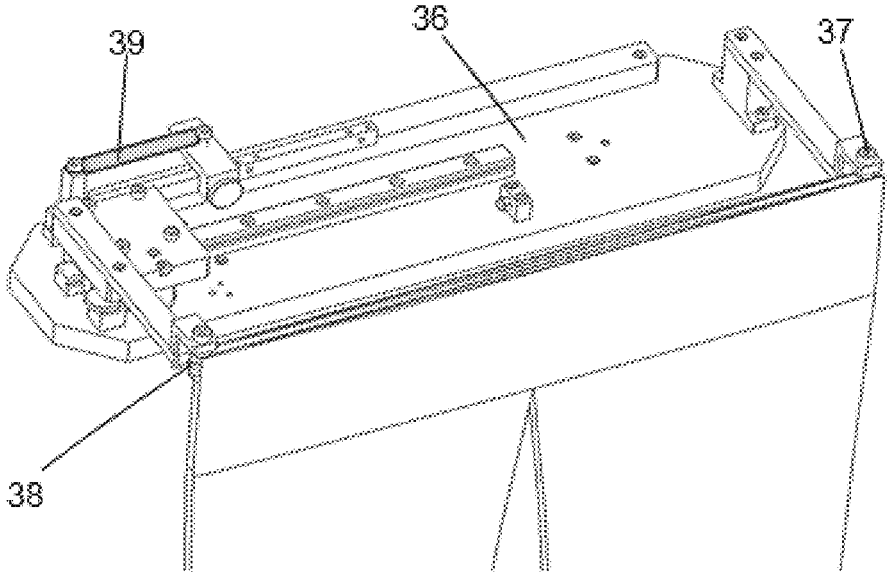
FIG. 17, a perspective view of the transporting unit of FIG. 16, with the moving finger in an extended position.

In FIG. 13 another preferred embodiment of the invention is shown. In this case, the device has a single supply module 1 that supplies trousers to six work stations 8. To this end, the device is organized in three blocks, each of them comprising two transport modules 5 and two work stations 8 (each block is, therefore, similar to the embodiment of the previous section). To supply the three blocks, the supply module 1 has transport means 3 that have a branch 33, so that the trousers introduced by the supply entry 2 are taken to three supply exits 4, each of them with its corresponding opening module 14 of the waist of one of the trousers. Each of the supply exits 4 is in each of the blocks and serves to supply trousers to the two transport modules 5 of each block. However, the supply module 1 has a single supply entry 2 fed by a single operator, whereby the production capacity per operator is greatly increased.

FIGS. 14 to 17 show another alternative of a supply module 1. The supply module has a supply entry 2 and a supply exit 4 united by transport means 3 that include a closed-loop circuit 35 and a plurality of transporting units 36 that are loaded with trousers by an operator at the supply entry 2. The transporting units 36 are carried from the supply entry 2 to the supply exit 4, unloaded by the transport module 5 at the supply exit 4, and carried back again to the supply entry 2 through the closed loop circuit 35. Each transporting unit 36 comprises an opening module 14, that includes two fingers 37 and 38 to be positioned inside the waist of the trousers, one at each of the lateral ends of the waist of the trousers. One of the fingers 37 is fixed to the transporting unit 36 and the other finger 38 can be moved along the transporting unit 36 (from a retracted position to an extended position) until the waist of the trousers is completely extended. A spring 39 makes an elastic force that tries to separate the moving finger 38 from the fixed finger 37, so that the waist of the trousers is maintained in a tensioned state. The thickness of the fingers 37 and 38 maintains both sides of the waist separated enough so that the waist perimeter is easily accessible for the fastening clamps 7 of the transport module 5. Once the fastening clamps 7 have picked up the waist of the trousers, a mechanism pushes the moving finger 38 back so that the waist is no more in a tensioned state and the transport module 5 can carry the trousers to the work station 8.

The invention claimed is:

1. A trouser treatment device, comprising:

[a] a trouser supply module, where each pair of trousers is manually insertable by an operator and is retainable by a waist of the trousers and hangs vertically, the trouser supply module comprising at least one transporting unit comprising an opening module, said opening module having two fingers, wherein each of the two fingers is sized such that a lower vertical end of each respective finger is configured to be located within the waist of the trousers, the two fingers being configured to selectively hold under tension the waist of the trousers such that the trousers are retained vertically by the trouser supply module,

[b] a work station with a trouser holder and a processing device, where said trouser holder has two legs able to lodge inside legs of said trousers, where each leg defines a longitudinal axis, where said trouser holder has a front part, corresponding to a front part of the trousers, and a back part, where each one of said legs has an inner edge, proximate to the other leg, and an outer edge, opposite said inner edge, and

[c] a transport module with a plurality of fastening clamps, each of the plurality of fastening clamps configured to grip an area of the waist of the pair of trousers held under tension by the two fingers of the trouser supply module that is located between the two fingers of the trouser supply module, said transport module being able to transport said pair of trousers from said trouser supply module to said trouser holder;

wherein the opening module comprises a spring to separate the two fingers so that the waist of the trousers is maintained in a tensioned state.

2. The trouser treatment device according to claim 1, wherein said work station has two trouser holders and in that said transport module is able to transport said pair of trousers from said trouser supply module to any of the trouser holders.

3. The trouser treatment device according to claim 1, wherein said trouser supply module is configured to transport each of said trousers from a supply entry to a supply exit and is configured to transport, with the at least one transporting unit, said pair of trousers from said supply exit to said trouser holder of the work station.

4. The trouser treatment device according to claim 1, wherein said work station comprises rotation means able to rotate said trouser holder according to a vertical axis or, if said work station has two trouser holders, rotation means able to rotate said trouser holders according to a vertical axis.

5. The trouser treatment device according to claim 1, wherein the opening module is configured to be disposed, at the trouser supply module, at a height of the waist of one of said trousers, and wherein said transport module with the plurality of fastening clamps is able to hold by the waist said pair of trousers with an open waist.

6. The trouser treatment device according to claim 3, wherein the opening module is configured to be disposed, at the trouser supply module, at a height of the waist of one of said trousers, and wherein said transport module with the plurality of fastening clamps is able to hold by the waist said pair of trousers with an open waist, and the opening module is arranged at said supply exit.

7. The trouser treatment device according to claim 6, wherein said opening module comprises pneumatic means able to open said waist by vacuum.

8. The trouser treatment device according to claim 5, wherein said opening module is arranged at a supply entry.

9. The trouser treatment device according to claim 3, wherein said trouser supply module comprises transport means, wherein said transport means comprise a closed loop circuit and a plurality of transporting units, each of said transporting units comprising the opening module that includes the two fingers able to be positioned inside the waist of the trousers, where a distance between both fingers is adjustable.

10. The trouser treatment device according to claim 1, wherein said trouser holder comprises a top support structure, with a fixing area to an upper part of trousers, and from which said two legs extend, and where each leg comprises a front flat face and a back face and a hollow space therebetween where an outer rod and an inner rod are lodged, where lower edges of said outer and inner rods are attached to a deployment mechanism of said rods able to deploy said rods towards an outside and an inside, respectively.

11. The trouser treatment device according to claim 10, wherein said trouser holder comprises a third rod arranged between both rods and a deployment mechanism of said third rod able to deploy said third rod towards a front or towards a back.

12. The trouser treatment device according to claim 1, wherein said trouser holder comprises a servomechanism, wherein the servomechanism is configured to adjust a fixing area to an upper part of the trousers.

13. The trouser treatment device according to claim 1, wherein said transport module comprises a robotic arm having said fastening clamps, said robotic arm being able to transport said pair of trousers from said trouser supply module to said trouser holder.

14. The trouser treatment device according to claim 1, wherein said processing device is a laser device.

15. The trouser treatment device according to claim 2, wherein said trouser supply module comprises transport means for transporting each of said trousers from a supply entry to a supply exit, and said transport module is able to transport said pair of trousers from said supply exit to any of the trouser holders.

16. The trouser treatment device according to claim 2, wherein any of said trouser holders comprises a top support structure, with a fixing area to an upper part of trousers, and from which said two legs extend, and where each leg comprises a front flat face and a back face and a hollow space therebetween where an outer rod and an inner rod are lodged, where lower edges of said outer and inner rods are attached to a deployment mechanism of said rods able to deploy said rods towards an outside and an inside, respectively.

17. The trouser treatment device according to claim 16, wherein any of said trouser holders comprises a third rod arranged between both rods and a deployment mechanism of said third rod able to deploy said third rod towards a front or towards a back.

18. The trouser treatment device according to claim 2, wherein said trouser holder comprises a servomechanism, wherein the servomechanism is configured to adjust a fixing area to an upper part of the trousers.

19. The trouser treatment device according to claim 2, wherein transport module comprises a robotic arm having said fastening clamps, said robotic arm being able to transport said pair of trousers from said trouser supply module to any of the trouser holders.

* * * * *